US005737848A

United States Patent [19]

Chau-Huu et al.

[11] Patent Number: 5,737,848

[45] Date of Patent: Apr. 14, 1998

[54] GUIDE ROLL ARRANGEMENT FOR PAPER MACHINE DRYING SECTION

[75] Inventors: Tri Chau-Huu; Albrecht Meinecke, both of Heidenheim, Germany

[73] Assignee: Voith Sulzer Papiermaschinen GmbH, Germany

[21] Appl. No.: 617,332

[22] Filed: Mar. 18, 1996

[30] Foreign Application Priority Data

Mar. 16, 1995 [DE] Germany ..... 195 09 581.2

[51] Int. Cl.[6] ..... F26B 11/02

[52] U.S. Cl. ..... 34/114; 34/115; 34/116; 34/117

[58] Field of Search ..... 34/114, 115, 116, 34/117, 121, 122, 123

[56] References Cited

U.S. PATENT DOCUMENTS 3,868,780 3/1975 Soininen et al. ..... 34/116
4,427,736 1/1984 Beacom et al. ..... 428/288
5,248,390 9/1993 Fissmann et al. ..... 162/193
5,404,653 4/1995 Skaugen et al. ..... 34/117
5,475,934 12/1995 Eskelinen et al. ..... 34/455
5,546,675 8/1996 McGraw et al. ..... 34/113

*Primary Examiner*—Henry A. Bennett
*Assistant Examiner*—Pamela A. O'Connor
*Attorney, Agent, or Firm*—Ostrolenk, Faber, Gerb & Soffen, LLP

[57] ABSTRACT

A drying section for drying a traveling web of paper, which has successive drying groups each having drying cylinders, a felt or wire belt supporting the traveling web and resting against the drying cylinders, and guide rolls serving for the guiding of the web to be dried and of the felt or wire belt. The guide rolls are so arranged that the traveling web is guided in meandering form in the transfer region between two successive drying cylinders associated with different felt or wire belts. The transfer region is between the felts of two successive drying groups or the transfer region is between two felts in the two rows of a two tier drying group.

18 Claims, 3 Drawing Sheets

GUIDE ROLL ARRANGEMENT FOR PAPER MACHINE DRYING SECTION

BACKGROUND OF THE INVENTION

The present invention relates to a drying section for drying a traveling web, particularly a web of paper and particularly relates to the arrangement of the web guide rolls and the dryer felt guide rolls particularly in the transfer regions between dryer groups.

Drying sections which comprise several successive drying groups through which the traveling web or web of paper is conducted are known, for instance, from Federal Republic of Germany published application 43 28 554 A1. The drying section may have single row or single tier drying groups or may have double row or double tier drying groups or a mixture of these groups. As it passes through a single row drying group, a web of paper is conducted by, a felt or a wire belt, also known as felt or dryer wire. On the one hand, this provides for good heat transfer to the web from the drying cylinder while on the other hand, the traveling web is supported. In order to avoid excessively large web tension due to changes in the length of the web of paper during the drying process, individual drying groups arranged one after the other may operate at slightly different speeds.

In the region of a separation between groups, i.e. in the transfer region between two adjoining drying groups, the web of paper is transferred from the felt of the one drying group to that of the following drying group. In a two row or two tier drying group which has an upper felt and a lower felt, the web of paper is also transferred from one felt to the other, i.e., between the top row felt and the bottom row felt in the double tier group, i.e., between the top row felt and the bottom row felt, and is also transferred between two felts when moving into or out of the double tier group.

In any transfer region between two successive drying cylinders which are wrapped by different respective felt webs, e.g., two successive drying groups or different tiers of a double tier group, the web of paper travels tangentially from the outer surface of one drying cylinder onto the outer surface of the next drying cylinder. If a felt is not present, a so called free path or open draw results, i.e., a section of web which is not supported by any felt. Fluttering of the web may result from this lack of support, which can cause a web tear, particularly when the paper web is still relatively moist. At higher speeds of web travel, this tear, of course, leads to disturbances in the operation of the paper machine.

It is further known that web shrinkage occurs in the region of the free path or open draw, particularly at the edge of the web of paper. This shrinkage at the edge is greater than the shrinkage at the region of the center of the web across the web. Tensions build up which lead to different paper properties at the edges and at the middle of the web of paper.

SUMMARY OF THE INVENTION

The object of the present invention is therefore to provide a drying section for drying a traveling web, particularly a web of paper, wherein the web is guided to assure that fluttering of the web and undesired shrinkage are reduced to a minimum.

This object is achieved in a drying section of the aforementioned type by arranging web guide rolls in the transfer region between successive drying groups such that the web follows a meandering path through the transfer region, rather than a straight line path. Because the web is guided in a meandering path by guide rolls located in the transfer region between two drying cylinders and which follow one after the other, supported guidance of the web between two successive drying cylinders is assured. Free paths or open draws, known from the prior art, are reduced to a minimum. In addition, longer contact zones than was previously possible are obtained between the web of paper and the drying cylinders adjacent the transfer region because of increased angles of wrap on the cylinders caused by the placement of the guide rolls.

In a particularly preferred embodiment, suction guide rolls are arranged in the transfer region between the two successive drying cylinders, so that lifting of the traveling web, e.g., by centrifugal force, from the surface of the guide rolls is avoided. Such a suction roll can have an internal or an external stationary suction box. See International Publications WO 83/00514 and WO 90/12151.

In a further preferred embodiment, a felt travels over two adjacent suction rolls in succession. They have a common suction box which is located on the outside of each suction roll. This suction box covers each of the suction rolls on the side of the roll which is not covered by the felt or by the web of paper.

Further objects, features and advantages of the drying section are described below with reference to the drawings.

For better clarity, known drives and bearing devices have been omitted from the Figures.

DETAILED DESCRIPTION OF THE INVENTION

Figure 1:
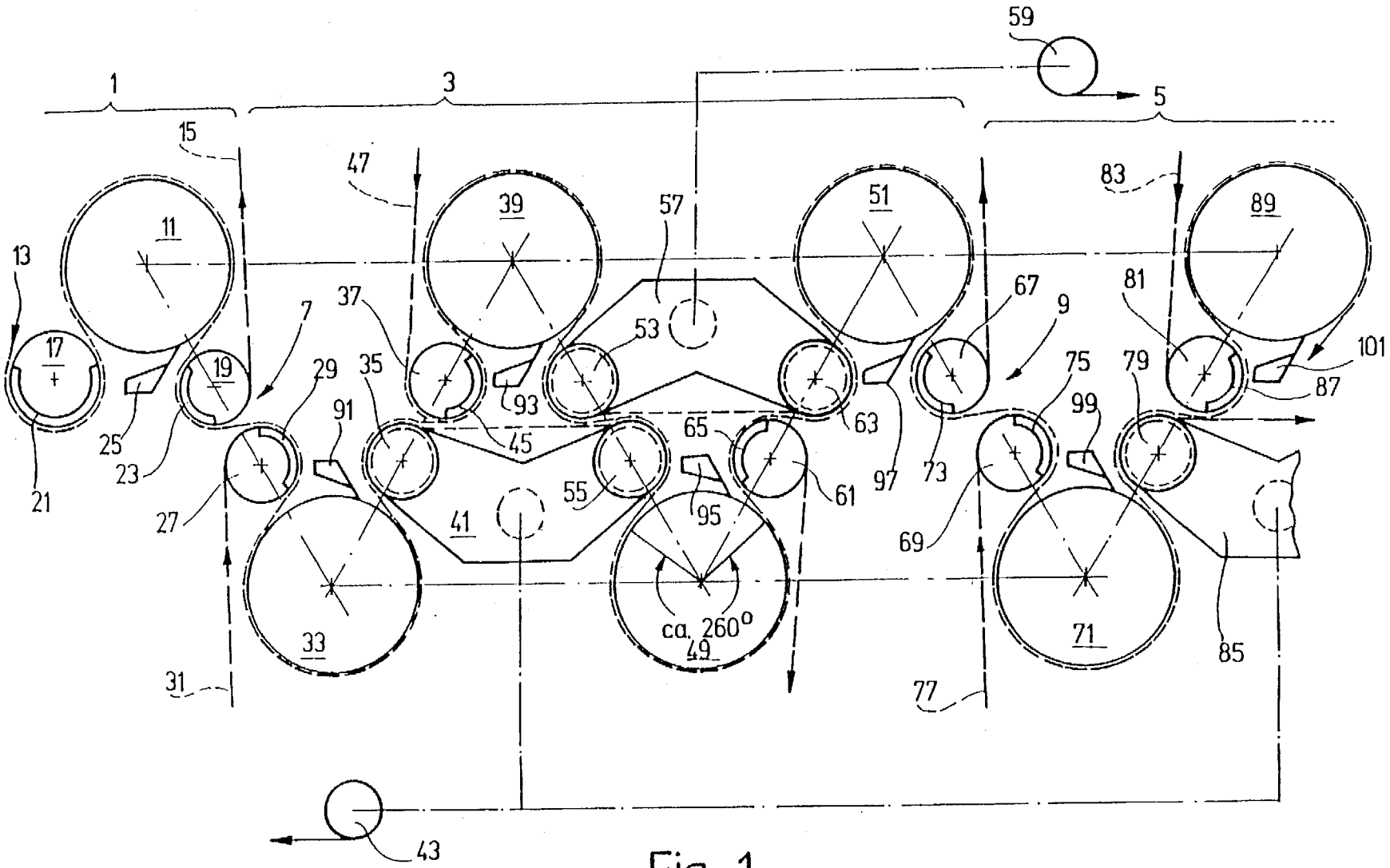
FIG. 1 is a diagrammatic side view of a portion of a first embodiment of a drying section.

The drying section shown in FIG. 1 has a single row or single tier drying group 1 followed by a first double row or double tier drying group 3. While the single tier drying group 1 is developed as a single felt group, the first double tier drying group 3 is developed as a two felt group. The first double tier group is followed finally by a second two row drying group 5, which again is developed as a two felt group. Each two felt group includes a top felt for the top row of drying cylinders and a bottom felt for the bottom row of drying cylinders.

In a single tier drying group, the traveling web or web of paper is dried by direct contact with drying cylinders only from one side of the web, while in a double tier drying group, the web is dried by direct contact with cylinders from both sides. So called two sidedness of the paper web is avoided here.

The successive drying groups are part of a drying section which dries a traveling web, in particular a paper web, and is, for instance, part of a paper machine.

Between the first drying group 1 and the second drying group 3, there is a first group separation or transfer 7, while between the second drying group 3 and the third drying group 5, there is a second group separation or transfer 9.

Only the last or downstream drying cylinder 11 of the first drying group 3 is shown here in this example. A paper web 13 to be dried is conducted around that cylinder. The web is guided and supported by an air pervious upper wire 15, also referred to as a felt or wire belt, which is shown in dashed line. For obtaining the optimum circumferential angle of wrap of the wire 15 around the surface of the drying cylinder 11, guide rolls, developed here as suction guide rolls 17 and 19, are arranged respectively upstream and downstream of the drying cylinder 11 as seen in the conveyance direction of the traveling web or paper web 13. These rolls are internal suction box guide rolls. Their respective suction regions 21, 23 are indicated by double arcuate lines. Along the circumferential length of a suction region, suction force is applied through the felt wrapped there and holds the supported web to the felt. The suction region 21 of the first guide roll 17 is arcuately longer than the suction region 23 of the second suction guide roll 19. The suction rolls avoid lifting of the paper web 13 off the wire 15. Between the two suction guide rolls 17 and 19, a scraper or doctor 25 cleans the surface of the drying cylinder 11 and/or upon starting up the paper machine, it conveys the front tip of the paper web edge strip.

The upper wire 15 of the first drying group leaves the suction guide roll 19 in the upward direction and is returned, via known suitable guide rolls and drive means, to the beginning of the first drying group 1.

In the first group separation or transfer region 7 between the first drying group 1 and the second drying group 3, the paper web 13 travels from the upper wire 15 after the guide roll 19 onto a lower wire 31, shown in dashed line, which wraps around a first suction guide roll 27 of the second drying group 3. The internal box suction region 29 of the suction roll 27 is again shown by a double curved line. The lower wire 31 returns in known manner over guide rolls and drive means from the final downstream end of the second drying group 3 around to the beginning of the second drying group, which is formed by the suction guide roll 27 and then through the second group to its end.

The paper web 13 therefore is without guidance and support only within a very small region solely in the region of the first group separation or transfer 7, forming there a so called free path or open draw of very short length.

From the suction guide roll 27, the web of paper 13 and the lower wire 31 are conducted onto the first drying cylinder 33 of the second drying group 3. From the cylinder 33, the web is conducted over two suction guide rolls 35 and 37 to the following drying cylinder 39 of the second drying group 3 in the web path. The second drying group has at least three drying cylinders, although four are illustrated, and frequently also six or eight may be used. The suction guide roll 35 which follows directly downstream of the drying cylinder 33 communicates with an external suction box 41. The box 41 is connected in a suitable manner with a suction fan 43 which operates to generate vacuum in the suction box 41. The arcuate region of the guide roll 35, which faces away from the lower wire 31 and the paper web 13, is surrounded by the suction box 41. The vacuum in the suction box is transmitted via known circumferential grooves in the circumferential surface of the suction guide roll 35 or via known holes passing through the entire circumference of the wall of the suction guide roll 35 to the arcuate region on which the web of paper 13 rests with the lower wire 31 on the suction guide roll 35. The suction on the paper web 13 substantially prevents transverse web shrinkage, particularly in the regions of the edges of the web.

The second suction guide roll 37 after the guide roll 35 in the web path is an internal suction box suction roll. It has a suction region 45 which is indicated by a double curved line. In the transfer region between the suction guide rolls 35 and 37, the web of paper 13 is guided or supported practically continuously. It is here transferred from the lower wire 31 onto an upper wire 47, shown in dashed line, which extends from around the suction guide roll 37. The paper web 13 and the upper wire 47 are guided over the suction region 45 of the suction guide roll and then pass around the second drying cylinder 39 of the second group 3.

In the embodiment of the second drying group 3 shown here, two further drying cylinders 49 and 51 are provided. The web of paper 13 is conducted from the drying cylinder 39 in a meander path over two suction guide rolls 53 and 55 to the drying cylinder 49. The suction guide roll 53 is provided with an external suction box 57 which is connected in a suitable known manner to a suction fan 59. The fan produces a vacuum within the suction box 57, which is transferred to the region in which the web of paper 13 and the upper wire 47 rest against the suction guide roll 53. For this purpose, the suction guide roll 53 is provided with circumferential grooves/or with holes which pass through the wall of the hollow suction guide roll 53.

The two suction guide rolls 53 and 55, as well the suction guide roll pair 23 and 27 and the pair 35 and 37 are respectively arranged so that the web of paper 13 is guided in a meandering path within each transfer region between successive web support felts or wire belts along the web path.

In the transfer region between the suction guide roll 53 and the suction guide roll 55, the web of paper 13 is first guided by the upper felt or wire 47 and thereafter guided by the lower felt or wire 31 providing a practically continuously supported transfer between the two suction guide rolls 53 and 55 so that a free path or open draw of the paper web 13 is avoided.

The suction guide roll 55 is also provided with an external suction box. In the embodiment shown, that suction box 41 provides both the suction guide rolls 35 and 55 with vacuum. The vacuum which is built up in the suction box 41 by means of the suction fan 43 is transferred via circumferential grooves and/or suitable holes passing through the wall of the suction guide roll 55 to the arcuate region of the suction guide roll 55 on which the web of paper 13 and the lower wire 31 rest.

After leaving the suction guide roll 55, the lower wire 31 and the paper web 13 wrap around the drying cylinder 49. Then they pass via suction guide rolls 61 and 63 onto the top row drying cylinder 51. The suction guide roll 61 is developed as an internal suction roll having a suction region 65 indicated by a double curved line.

After passing the suction guide roll 61, the lower wire 31 is conducted downward at what is now the end of the second group and is returned in suitable manner to the suction roll 27 at the beginning of the second drying group 3. In the transfer region between the suction guide rolls 61 and 63, the web of paper 13 is again transferred from the lower wire 31 practically directly onto the upper wire 47.

The suction guide roll 63 is provided with an external suction box. Here, the suction box 57, which acts with vacuum on the suction guide roll 53, is developed so that it also provides the suction guide roll 63 with vacuum. Via circumferential grooves or through holes passing through the wall of the suction guide roll 63, the vacuum generated by the vacuum fan 59 in the suction box 57 is transferred to the arcuate region of the suction guide roll 63 around which the web of paper 13 and the upper wire 47 rest against the suction guide roll 63.

From the drying cylinder 51, which is the final cylinder in the second drying group 3, the web of paper 13 passes, via two suction guide rolls 67 and 69, onto the first drying cylinder 71 of the third drying group 5. The two suction guide rolls 67 and 69 are developed as internal suction rolls. The respective suction regions 73 and 75 of the suction guide rolls 67 and 69 lie within the contact region of the web of paper 13 and are indicated by a double arcuate line.

After the suction guide roll 67, which is the last roll of the second drying group 3, the upper wire 47 is returned and guided in suitable manner to the first roll, the suction guide roll 37 of the second drying group.

The suction guide roll 69 is the first roll of the third drying group 5. A lower wire 77, shown in dashed line, of the third drying group 5, guides and stabilizes the web of paper 13 as it is conducted over this roll.

In the region of the second group separation 9 or transfer between the second drying group 3 and the third drying group 5, the web of paper is drier and thus more stable than in the region of the first group separation 7. In view of this, the distance between the surfaces of the final suction guide roll 67 of the second drying group 3 and the first suction guide roll 69 of the third drying group 5 is also greater than the distance between the rolls 35 and 37. This spacing creates a free paper path or open draw which permits reduction of longitudinal stresses within the web of paper. For also reducing web stresses, the third drying group 5 is preferably driven at a slightly slower speed than the second drying group 3.

The third drying group 5 like the second group is in this case developed as a two felt or two tier group. The paper web 13 leaving the drying cylinder 71 is transferred via a first suction guide roll 79 onto a second suction guide roll 81 which is wrapped, at least in a region thereof, by an upper wire 83. The suction guide roll 79 which directly follows the drying cylinder 71, as seen in the direction of travel of the paper web 13, has an external suction box 85 which, in known suitable manner, for instance through circumferential grooves or through holes provided in the wall of the hollow suction roll 79, supplies vacuum in the arcuate region in which the paper web 13 and the lower wire 77 rest against the suction guide roll 79.

The lower wire 77 of the third drying group passes around the first suction roll 69 of the third group with the web passing over the outside of the wire 77, then wrapping around the cylinder 71, holding the web directly to the cylinder then around the suction roll 79 and past the suction box 85. The upper wire 83 of the third group wraps the roll 81 with the web outside that wire.

The suction guide roll 81 is developed as an internal suction roll. Its suction region 87 is indicated by a double arcuate line. The two suction guide rolls 79 and 81 are arranged so that the paper web is conducted along a meandering path from the drying cylinder 71 onto the following second drying cylinder 89 in the top row of the third drying group 5.

The construction of the third drying group 5 can be determined according to requirements. It comprises at least the two illustrated drying cylinders 71 and 89, but it may also have four drying cylinders and may be developed in the same manner as the second drying group 3 or it may have any other quantity of cylinders or other known single or double tier arrangement.

The suction box 85 of the third drying group 5 is connected in suitable manner to the suction fan 43 which also supplies vacuum on the suction box 41 of the second drying group 3. Differing from what is shown, each of the internal suction box suction guide rolls (for instance 19, 27, 81, etc.) can be replaced with an external suction roll. In another variant, all of the suction guide rolls can have internal suction boxes, including those which are shown provided with external suction.

FIG. 1 shows the drying cylinders 33, 39, 41, 51, 71 and 89 with respective associated scrapers 91, 93, 95, 97, 99 and 101 which can be of the same construction as the scraper 25 on the cylinder 11. They clean the surfaces of the drying cylinders and strip off air that is entrained by the moving surfaces of the drying cylinders.

The drawing shows the web of paper 13 conducted on a meandering path through the transfer regions between two successive drying groups. Therefore, in the regions of the first and the second group separations, or draws 7 and 9, guide rolls which are developed as suction guide rolls define that path. Therefore, the web is not transferred along a straight line from a drying cylinder of the one drying group to the following drying cylinder of the following drying group, and not along the straight line that forms a tangent to both drying cylinders. A free path or open draw in the transfer region between two successive drying groups can thus be practically completely avoided since the paper web is transferred directly from the felt of the one drying group to the felt of the next drying group. This substantially reduces shrinkage of the web, particularly in the regions of its edges, so that very uniform paper properties result across the web.

The principle of a meandering transfer path of the paper web from one drying cylinder to the next can also be realized wholly within a single drying group that is developed in two rows or two tiers. The web of paper then directly transfers from the lower wire of the two row double felt group directly onto the upper wire thereof, and vice versa.

The meandering path of the web of paper in the transfer region between two drying cylinders causes a very large arcuate wrap angle around the cylinders, for instance, an angle of about 260° can also be obtained, as contrasted with traditional drying sections which produce an angle of wrap of about 214°. The heat energy given off by the drying cylinders is therefore utilized better. Further, the meandering path of the web of paper in the transfer region increases the evaporation path for the web, providing drying.

In the embodiment shown in FIG. 1, the second and third drying groups 3 and 5 have been developed as two row or two tier drying groups. It is also possible to develop all of the drying groups of the drying section in two rows or one row. The meandering transfer in the region of the group separations is essential to the invention, while a meandering transfer of the web of paper also within the individual groups is possible in the case of two row drying groups.

The number of drying cylinders within a drying group can be freely selected. Therefore, more than or fewer than four drying cylinders can be provided in any group. The length of a drying group depends on the region of the drying section in which the group is arranged and may be dependent upon the shrinkage behavior of the web to be dried. In the region of extensive web shrinkage, in order to avoid large stresses within the web, shorter length, fewer cylinder groups are preferred. This enables providing specifically designed free paths or open draws in the transfer regions between the successive groups where equalization of web tensions is possible.

The distance between adjacent suction guide rolls at the group separations is also adapted to the condition of the paper at the time. If the web is still relatively wet, the distance should be small since the web is still minimally stable. Later along the web path, longer distances between successive rolls can be permitted, since the web is by then already more stable. A minimum spacing distance between guide rolls is always necessary in order to enable threading of the felt or the wire belt.

In the drying section embodiment shown in FIG. 1, the drying cylinders are not arranged directly one after the other in one or two superimposed rows, but are instead arranged in V-shape in order to reduce the overall length of the drying section. In this connection, the center lines or axes of each two drying cylinders that follow each other in the direction of conveyance of the traveling web or web of paper and those of the corresponding suction guide rolls between those cylinders are arranged on a straight line. However, this is not required. It is essential only that there be meandering guidance of the web of paper in the transfer regions between at least some of the pairs of two successive drying cylinders.

The web of paper is conducted so well by its meandering guidance that the threading of the edge strip or tail is readily possible. Therefore, frequently, no additional rope guidance is necessary upon the start up of running of the paper machine or after a break in the web of paper to thread the web of paper again into the drying section. However, blast air jets coming from the scrapers, for instance, 25, 95, 101 may be used, as is known per se from Federal Republic of Germany 39 41 242 A1 as their use is advantageous.

Figure 2:
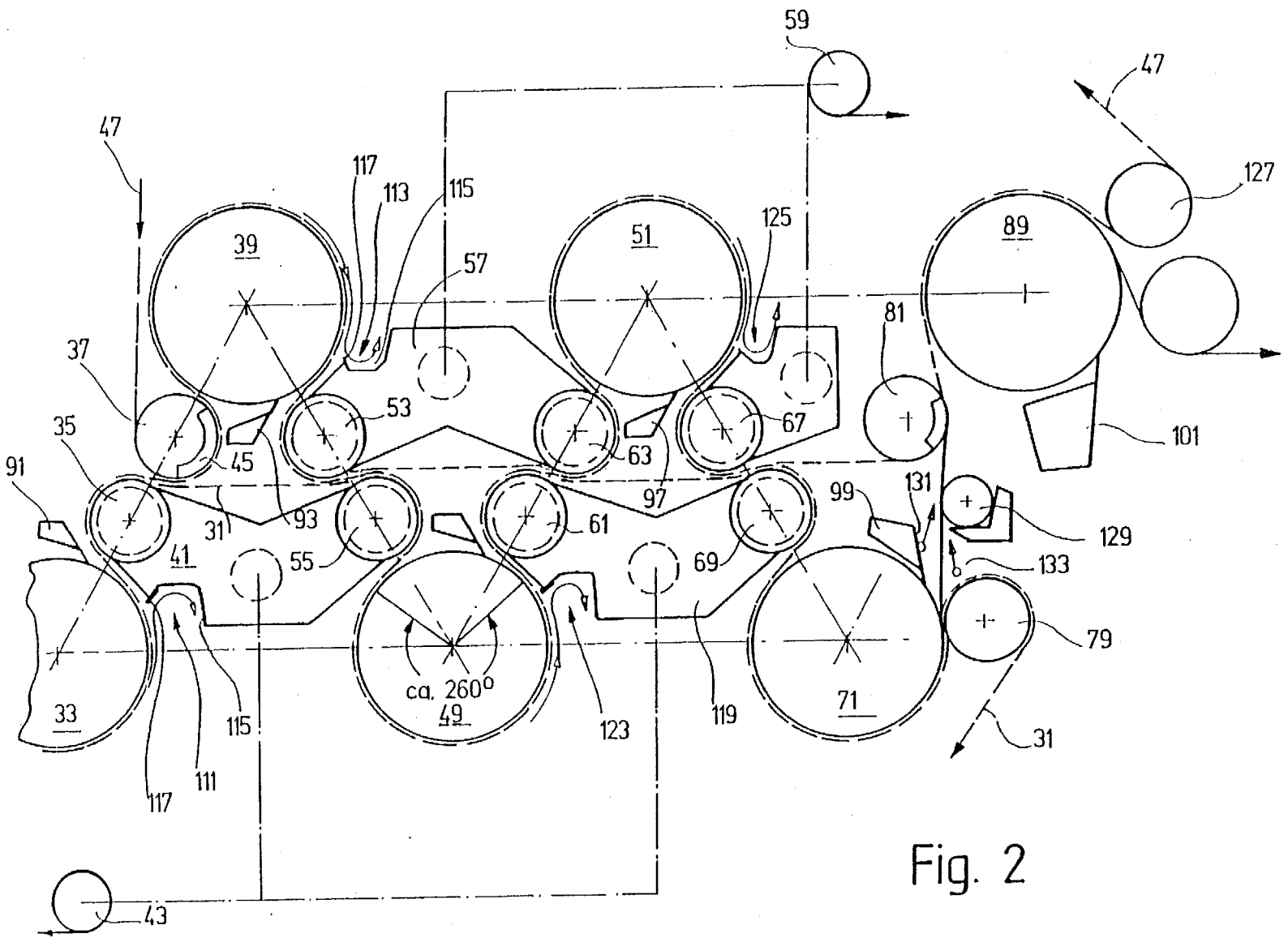
FIG. 2 is a diagrammatic side view of a portion of a second embodiment of a drying section.

FIG. 2 shows a second embodiment of a drying section which corresponds essentially to the drying section embodiment shown in FIG. 1. Repeat description of identical parts is avoided.

One essential difference in the embodiment shown in FIG. 2 is the design of the suction boxes 41, 57. Each box has an air deflection device 111 or 113. These are arranged in the upstream sections of the suction boxes and face respective wire belts. The air deflection devices 111, 113 comprise a recess 115 and an air deflection rail 117. The air deflection rail 117 is inclined to the direction of transport, i.e., to the lower belt 31 and inclines in toward and terminates close to the upper wire belt, so that there is only a small slot between the wire belt and the longitudinal edge of the air deflection rail.

The air deflection devices 111, 113 are provided to essentially peel off the boundary layer of air adjoining the upper wire belt and entrained with it and lead it away from the wire belt, as indicated by the arrows in FIG. 2. The peeling off of the air boundary layer produces a region of lower air pressure in the direct downstream region of the air deflection rail 117. As a result, the web of paper traveling along the rail is drawn in. Thus, the air deflection devices 111, 113 cause the web of paper to detach itself from the drying cylinders and continue along with the wire belt.

In contrast to the embodiment shown in FIG. 1, a suction box 119 is associated with the two suction rolls 61, 69 and a further suction box 121 is associated with the suction roll 67. Both suction boxes 119, 121 have air deflection devices 123, 125, as described above.

Another difference from the first embodiment resides in the guidance of the wire belt 47 associated with the upper row of drying cylinders and the wire belt 31 associated with the lower row of drying cylinders. The upper wire belt 47 is not returned from the suction roll 67, but it first travels further around the suction roll 81 and the drying cylinder 89 and is then returned over a normal belt guide roll 127. The same type of pathway change is done with the lower wire belt 31, which does not return travel from the suction roll 61, but instead first passes around the suction roll 69, the drying cylinder 71 and finally around the normal belt guide roll 79.

This modified guidance of the wires produces a free paper path upon the transfer of the web of paper from the drying cylinder 71 to the drying cylinder 89. In this region, sufficient space is thus created to arrange a tail cutter 129, known from the prior art. Such a tail cutter is customarily arranged in the region of the last drying group in order to cut off an edge strip for threading of the web of paper into the following units.

Blast air nozzles 131, 133 are provided on both sides of the web of paper and between drying cylinder 71 and tail cutter 129. They blow against the paper web in the direction of its transport. This assists the transport of the paper web, particularly upon the threading.

In a modification of the embodiment shown in FIG. 2, the last upper drying cylinder 89 can be replaced by an independent top felted drying cylinder or by an additional single row, top felted drying group having, for instance, two or three drying cylinders.

Figure 3:
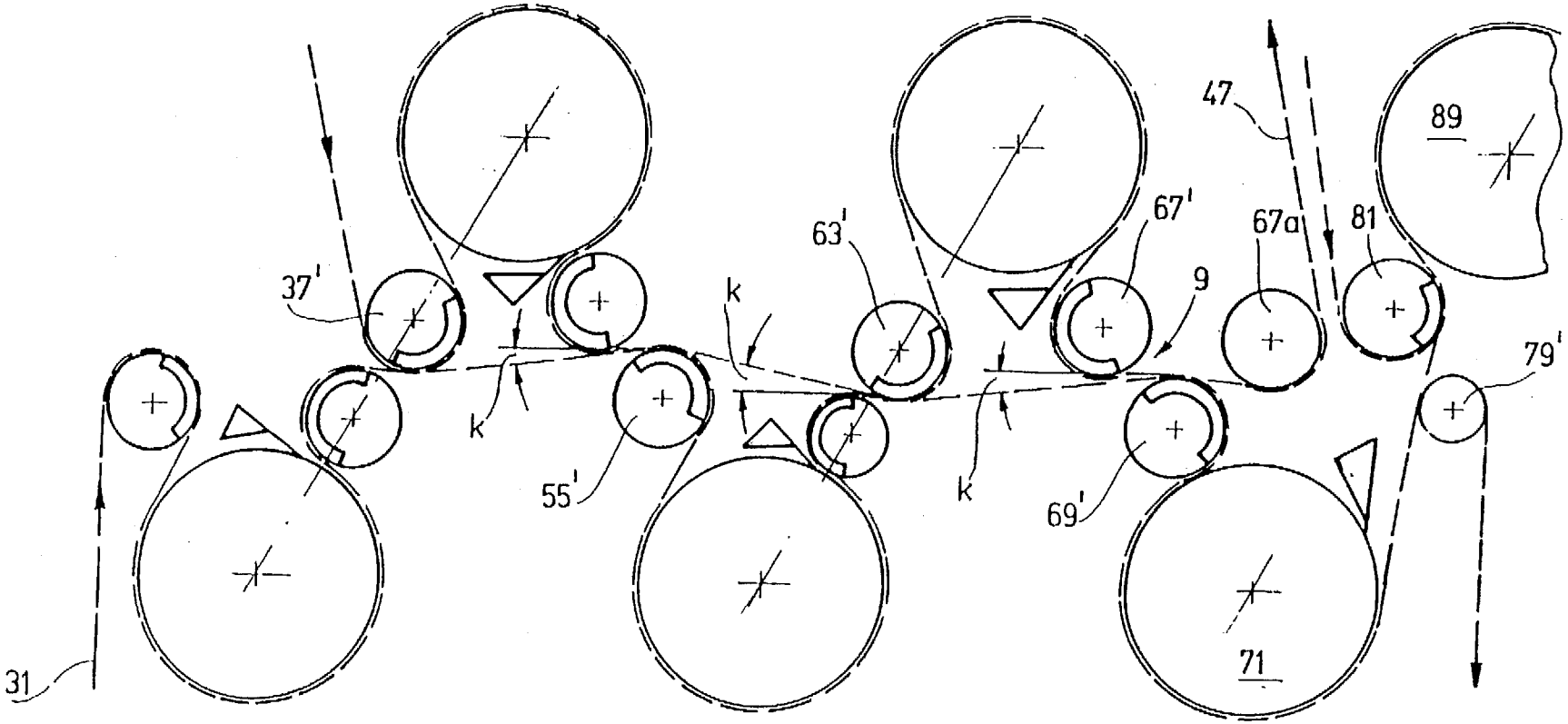
FIG. 3 is a diagrammatic side view of another embodiment.

FIG. 3 shows another embodiment, wherein only essential parts have been shown diagrammatically for clarity of the drawing. Otherwise, FIG. 3 corresponds to the embodiment already described with reference to FIG. 1.

It can be clearly noted that the lower and upper wires 31 and 47 are conducted in a converging manner in front or just upstream of the suction guide rolls 37', 55', 63', 69', at an angle of convergence k formed by the two wires at each of the above rolls. To provide such an angle of convergence at the end of the drying group, an additional wire guide roll **67*a* is provided for the wire 47 following the last suction guide roll 67'**.

In addition, the web of paper travels from the last lower drying cylinder 71 of the two row drying group substantially linearly to the first suction guide roll 81' of the following drying group which may be developed in a single row or with two rows.

These additional measures facilitate the threading of the edge strip upon the starting up of the paper machine. The suction guide rolls may be further improved by providing separate suction zones in the region of the edge strip, as disclosed, for instance, in International Publication WO 83/00514.

A short free paper path or open draw is provided between the belt guide roll 79' and the suction guide roll 81. However, the roll 81 can instead be arranged lower and closer to the roll 79', so that it receives the paper web, along with the new wire coming from above, from the wire 31.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A drying section of a machine for drying a traveling web of paper, the drying section including at least one drying group and the drying group including a plurality of drying cylinder arranged in at least first and second rows of the drying cylinders;

a respective third and fourth row of guide rolls respectively at the first and second rows of drying cylinders, the guide rolls of each of the third and fourth rows being disposed between at least some of the neighboring ones of the drying cylinders within the respective first and second row of drying cylinders;

a respective first felt or wire belt wrapping over the first drying cylinders in the first row and over the third row of guide rolls; the first felt supporting the web to be alternately partially wrapped around and in contact with the surface of one of the first drying cylinders and then partially wrapped around and supported by the surface of the one guide roll in the third row that is next in the felt path through the drying group;

a respective second felt or wire belt wrapping over the second drying cylinders in the second row and over the fourth row of guide rolls; the second felt supporting the web to be alternately partially wrapped around and in contact with the surface of one of the second drying cylinders and then partially around and supported by the surface of the one guide roll in the fourth row that is next in the felt path through the drying group; the wrapped paths of the first and second felts permitting the web to transfer from one of the drying cylinders in one of the first and second rows to one of the drying cylinders in the other of the first and second rows;

the transfer of the web from one of the drying cylinders in one of the first and second rows to a next successive drying cylinder in the other of the first and second rows being a space between the successive drying cylinders which comprises a transfer region between those two cylinders; and a respective one of each of the third and the fourth row guide rolls in the transfer region between the one drying cylinder in one of the first and second rows and the next successive drying in the other of its first and second rows for guiding the web to pass from one of the drying cylinders in one row through the transfer region and partially wrapped around each of the respective third and fourth row guide rolls to the next successive drying cylinder in the other row over a meandering form pathway;

the guide rolls being so positioned in the transfer region and the felts being supported against the guide rolls that the web is substantially continuously supported on its path from the first of the guide rolls of the third and fourth rows to the second of the guide rolls in the other of the third and fourth rows and through the transfer region;

the guide rolls in the transfer region and the two drying cylinders in the first and second rows disposed at ends of the transfer region which are so positioned that the traveling web is supported on a first side thereof by the first felt or wire belt and on the second side thereof by the second felt or wire belt.

2. The drying section of claim 1, wherein there is a first one of the felts or wire belts that passes over the one drying cylinder and a second one of the felts or wire belts that passes over the successive drying cylinder;

the first and second felts or wire belts both passing through the transfer region, wherein the first wire belt carries the web into the transfer region and the second wire belt carries the web out of the transfer region to the successive cylinder and the transfer means comprises said at least two guide rolls in the transfer region disposed for guiding the web along a meandering pathway through the transfer region.

3. The drying section of claim 1, further comprising first guide means for the first felt or wire belt for guiding the first felt or wire belt through one of a top and a bottom return path; and second guide means for the second felt or wire belt for guiding the second felt or wire belt through the other of a top and bottom return path.

4. The drying section of claim 1, further comprising an air deflection device associated with at least one of the successive drying cylinders, the deflection device being positioned and adapted to deflect an entrained air boundary layer off the felt or wire belt in the region where the felt or wire belt departs from the respective drying cylinder provided with the air deflection device.

5. The drying section of claim 4, wherein the air deflection device is provided generally at the first of the drying cylinders in the transfer region.

6. The drying section of claim 1, wherein the first and second guide rolls comprise first and second guide means for the first and second felt or wire belt into and through the transfer region, and for guiding the first and second felts or wire belts to converge toward each other in the region of travel to and through the transfer region onto the web.

7. The drying section of claim 1, wherein at least one of the first and second guide rolls is an internal suction roll with an internal suction box which communicates through its surface with the felt or wire belt wrapped around the suction guide roll.

8. The drying section of claim 7, wherein both of the guide rolls are internal suction guide rolls.

9. The drying section of claim 7, wherein the suction guide roll has a surface with holes therethrough communicating between the internal suction box and the exterior of the guide roll where the felt or wire belt wraps around the guide roll.

10. The drying section of claim 1, wherein each of the suction guide rolls is an internal suction roll having a surface with holes therethrough communicating between the respective internal suction box and the exterior of the guide roll where the felt or wire belt wraps around the guide roll.

11. The drying section of claim 1, wherein at least one of the first and second guide rolls is an external suction guide roll; an external suction box communicating with the surface of the external suction guide roll for supplying suction thereto, and the external suction guide roll having means at the surface thereof for communicating vacuum to the felt or wire belt passing thereover.

12. The drying section of claim 11, wherein both of the first and second suction guide rolls comprise external suction guide rolls and at least one suction box communicating with each of the external suction guide rolls for delivering suction thereto.

13. The drying section of claim 11, wherein the external suction guide roll includes circumferential grooves therearound and the external suction box communicates with the grooves around one region of the surface of the guide rolls, and the felt or wire belt communicates with another region around the surface of the guide roll, whereby the circumferential grooves transmit the vacuum from the suction box to the felt or wire belt.

14. The drying section of claim 1, wherein the guide rolls for guiding the web to pass in a meandering form pathway comprises at least two felt or wire belt guide rolls disposed in the transfer region between the successive drying cylinders, the guide rolls being placed so that the web is guided through the transfer region off the first of the dryer cylinders and passing over the two guide rolls in succession and then over the successive drying cylinder on a meandering path.

15. The drying section of claim 14, wherein the first and second cylinders have respective first and second centers of rotation and the rolls of the third and fourth rows have respective third and fourth centers of rotation, the centers of rotation being arranged such that a line passing through the centers of rotation of the one cylinder in one of the first and second rows and the next successive drying cylinder in the other of the first and second rows passes through the centers of both the guide rolls in the third and fourth rows in the transfer.

16. The drying section of claim 15, wherein the third and fourth centers of rotation of the guide rolls are disposed on the line passing through the first and second centers of rotation of the one and the successive drying cylinder.

17. The drying section for drying a traveling web of paper, the drying section including a succession of drying cylinders along the path of the web passing through the drying section;

the drying section being divided into a series of successive drying groups, with each of the drying groups having at least one of the drying cylinders therein;

at least one felt or wire belt respectively for each of the drying groups for guiding the traveling web as its travels through the respective drying group;

at least two successive ones of the drying cylinders in the drying section being spaced apart to define a transfer region for the web between the successive cylinders; the transfer region is between successive drying groups, and the first and the second guide rolls are disposed in the transfer region between the successive drying groups; the first felt is in the first of the two successive drying groups and the second felt is in the second of the two successive drying groups, whereby the transfer region is between two of the drying cylinders at a transfer between two successive groups;

at least two felt or wire belt guide rolls disposed in the transfer region between the two successive drying cylinders, the at least two guide rolls being placed so that the web is guided off the first of the dryer cylinders and passes over the two guide rolls in succession and then over the next drying cylinder in succession and so that the web travels on a meandering path from the first mentioned to the successive drying cylinder in its path through the transfer region, the first felt wraps around the first of the guide rolls in the transfer region and the second felt wraps around the second of the guide rolls in the transfer region, and the felts supporting the web moving into and then out of the transfer region;

a transfer area defined between the first and second guide rolls, whereby transfer of the web from the first to the second of the felts occurs in the transfer area defined between the first and the second rolls;

at least one additional felt or wire belt guide roll in the transfer region for providing a path of return of at least one of the felts or wire belts to the beginning of the respective drying group after the felt or wire belt has passed over the respective one of the guide rolls in the transfer region.

18. The drying section of claim 17, further comprising a respective additional felt or wire belt guide roll in the transfer region for each of the first and second felts for returning the felts to pass through the respective dryer groups.

* * * * *